US008721807B2

(12) United States Patent
Bramfitt et al.

(10) Patent No.: US 8,721,807 B2
(45) **Date of Patent: *May 13, 2014**

(54) HYPEREUTECTOID, HEAD-HARDENED STEEL RAIL

(75) Inventors: Bruce L. Bramfitt, Bethlehem, PA (US); Fred B. Fletcher, Wayne, PA (US); John A. Davis, Jr., Harrisburg, PA (US)

(73) Assignee: Arcelormittal Investigacion Y Desarrollo, S.L., Sestao (ES)

( * ) Notice: Subject to any disclaimer, the term of this patent is extended or adjusted under 35 U.S.C. 154(b) by 10 days.

This patent is subject to a terminal disclaimer.

(21) Appl. No.: 13/584,145

(22) Filed: Aug. 13, 2012

(65) Prior Publication Data

US 2012/0298263 A1 Nov. 29, 2012

Related U.S. Application Data

(63) Continuation of application No. 12/794,191, filed on Jun. 4, 2010, now Pat. No. 8,241,442.

(60) Provisional application No. 61/286,264, filed on Dec. 14, 2009.

(51) Int. Cl.

| | |
|---|---|
| ***C22C 38/02*** | (2006.01) |
| ***C22C 38/04*** | (2006.01) |
| ***C22C 38/14*** | (2006.01) |
| ***C22C 38/12*** | (2006.01) |

(52) U.S. Cl.

USPC ..... 148/320; 148/328; 148/333; 420/126; 420/124

(58) Field of Classification Search

USPC ..... 148/581, 584, 320, 569, 333–336, 328; 420/124, 126

See application file for complete search history.

(56) References Cited

U.S. PATENT DOCUMENTS

| | | | |
|---|---|---|---|
| 4,486,248 | A | 12/1984 | Ackert |
| 4,838,963 | A | 6/1989 | Huchtemann |

(Continued)

FOREIGN PATENT DOCUMENTS

| | | | |
|---|---|---|---|
| CN | 1793403 | A | 6/2006 |
| EP | 2196552 | A1 | 6/2010 |

(Continued)

OTHER PUBLICATIONS

Machine-English translation of JP 2000-345296, Ueda Masaharu et al., Dec. 12, 2000.*

(Continued)

*Primary Examiner* — Deborah Yee

(74) *Attorney, Agent, or Firm* — Berenato & White, LLC

(57) ABSTRACT

A method of making a hypereutectoid, head-hardened steel rail is provided that includes a step of head hardening a steel rail having a composition containing 0.86-1.00 wt % carbon, 0.40-0.75 wt % manganese, 0.40-1.00 wt % silicon, 0.05-0.15 wt % vanadium, 0.015-0.030 wt % titanium, and sufficient nitrogen to react with the titanium to form titanium nitride. Head hardening is conducted at a cooling rate that, if plotted on a graph with xy-coordinates with the x-axis representing cooling time in seconds, and the y-axis representing temperature in Celsius of the surface of the head of the steel rail, is maintained in a region between an upper cooling rate boundary plot defined by an upper line connecting xy-coordinates (0 s, 775° C.), (20 s, 670° C.), and (110 s, 550° C.) and a lower cooling rate boundary plot defined by a lower line connecting xy-coordinates (0 s, 750° C.), (20 s, 610° C.), and (110 s, 500° C.).

20 Claims, 9 Drawing Sheets

(56) References Cited

U.S. PATENT DOCUMENTS

| | | | | |
|---|---|---|---|---|
| 5,658,400 | A | 8/1997 | Uchino et al. | |
| 5,762,723 | A | 6/1998 | Ueda et al. | |
| 5,830,286 | A | 11/1998 | Ueda et al. | |
| 7,217,329 | B2 | 5/2007 | Cordova | |
| 7,288,159 | B2 | 10/2007 | Cordova | |
| RE40,263 | E | 4/2008 | Ueda et al. | |
| RE41,033 | E | 12/2009 | Ueda et al. | |
| 8,241,442 | B2 * | 8/2012 | Bramfitt et al. | 148/681 |
| 2004/0187981 | A1 | 9/2004 | Ueda et al. | |
| 2007/0181231 | A1 | 8/2007 | Ueda et al. | |
| 2008/0011393 | A1 | 1/2008 | Ueda et al. | |
| 2009/0314049 | A1 | 12/2009 | Ueda et al. | |

FOREIGN PATENT DOCUMENTS

| | | | |
|---|---|---|---|
| GB | 2161831 | A | 1/1986 |
| JP | 11092867 | A | 4/1999 |
| JP | 2000178690 | A | 6/2000 |
| JP | 2000219939 | A | 8/2000 |
| JP | 2000226637 | A | 8/2000 |
| JP | 2000345296 | A | 12/2000 |
| JP | 2005171326 | A | 6/2005 |
| JP | 2005171327 | A | 6/2005 |
| JP | 2007291413 | A | 11/2007 |
| JP | 2007291418 | A | 11/2007 |

OTHER PUBLICATIONS

Thermo-Calc Software brochure(2009), 2 pages.

AREMA, AREMA Manual for Railway Engineering, Part 2, Manufacture of Rail, 2007, pp. 4-2-1 to 4-2-15.

Pavlov, "Production of Wear-Resistant Rail", Steel in Translation, 2007, pp. 836-838, vol. 37, No. 10.

Ueda et al, "Application of Hypereutectoid Steel to Heavy Haul Track Rail", Thermomechanical Processing and Mechanical Properties of Hypereutectoid Steels and Cast Irons, The Minerals, Metals & Materials Socitey, 1997, pp. 161-174.

Han, "Effects of vanadium additions on microstructure and hardness of hypereutectoid pearlitic steels", Materials Science and Engineering A190, 1995, pp. 207-214.

Pan et al, "Production of Wear-Resistant Rails at the NTMK", 1994 Rail Steels Symposium Proceedings, pp. 19-22.

Han et al, "Pearlite Phase Transformation in Si and V Steel", Metallurgical and Materials Transactions A, Jul. 1995, vol. 26A, pp. 1617-1631.

Uchino et al, "Development of Hypereutectoid Steel Rail for Heavy Haul Railways", 99th MWSP Conf. Proc., Iss, 1998, vol. 35, pp. 1047-1055.

Fletcher et al, "Fast-welding chromium—molybdenum—vanadium extra-high strength rail steels", Vanadium in Rail Steels, Proceeding of Seminar, Nov. 8, 1979, pp. 41-47.

Han et al, "Optimization of Mechanical Properties of High-Carbon Pearlitic Steels with Si and V Additions", Metallurgical and Materials Transactions A, vol. 32A, Jun. 2001, pp. 1313-1324.

Machine-English translation of Japanese Patent No. 2000-345296, Ueda Masaharau et al, Dec. 12, 2000.

Liu et al, "Characteristics of Continuous Cooling of UIC900A and U75V Rail STeel for Welding", China Railway Science, vol. 26, No. 6, pp. 63-68. English Abstract attached, Nov. 2005.

State Intellectual Property Office of the People's Republic of China, English Translation of Search Report issued for Application No. 201080062517.3 filed Dec. 14, 2010.

* cited by examiner

HYPEREUTECTOID, HEAD-HARDENED STEEL RAIL

CROSS-REFERENCE TO RELATED APPLICATION(S)

This application is a continuation of application Ser. No. 12/794,191 filed Jun. 4, 2010, now U.S. Pat. No. 8,241,442, and this application claims the benefit of priority under 35 U.S.C. §119(e) of provisional application 61/286,264 filed on Dec. 14, 2009, the complete disclosures of which is are incorporated herein by reference.

FIELD OF THE INVENTION

The present invention relates to a method of making a hypereutectoid, head-hardened steel rail. The present invention further relates to the hypereutectoid, head-hardened steel rail.

BACKGROUND OF THE INVENTION

United States railroads, especially the Class 1 railroads (BN, UP, CSX, NS, CP and CN) are demanding higher hardness levels and deeper hardness in the head of railroad rail for improved in-track life (higher hardness gives better wear resistance). The American Railway Engineering and Maintenance-of-Way Association (AREMA) is one of the recognized organizations for promulgating rail specifications in North America. There are three types of AREMA rail steel based on minimum properties: standard strength, intermediate strength, and high strength. The minimum properties for each steel type are set forth in the table below:

| Property Specified | Standard Strength | Intermediate Strength | High Strength |
|---|---|---|---|
| Hardness, Brinell HB (HRC) | 310 (30.5) | 325 (32.5) | 370 (38.3) |
| Yield strength, ksi | 74 | 80 | 120 |
| Tensile strength, ksi | 142.5 | 147 | 171 |
| Elongation (in 2"), % | 10 | 8 | 10 |

The hardness is specified in the rail head only. The above properties as reported and measured herein are tested according to AREMA standards set forth in AREMA Part 2, Manufacture of Rail (2007). To meet the AREMA standards of high strength, the rail must have a fully pearlitic microstructure with substantially no untempered martensite allowed. Generally, the elongation should be 10% or higher for high strength rail steel, although a relatively small number (e.g., about 5 percent) of rails may have an elongation less than 10% but no lower than 9%.

The most difficult grade to produce is the high strength grade. Some rail producers strive to achieve the required properties of high strength steel through accelerated cooling of the rail directly in-line after the rolling mill. Other producers reheat the rail from ambient temperature and then apply accelerated cooling (an off-line process). The process of cooling the rail is called head hardening. In the United States, the currently practiced cooling processes use either water sprays to cool the rail or high volume air manifolds. In all the head hardening processes the rail is cooled at a moderate cooling rate to form a fine pearlitic microstructure and to avoid the formation of untempered martensite which is not allowed by AREMA.

In addition to accelerated cooling to develop a fine pearlite interlamellar spacing, it is known to add alloying elements to the rail steel to increase hardness. Traditionally for the past decade, it has been known in the United States to use high strength head-hardened steel containing 0.80-0.84 wt % C, 0.80-1.1 wt % Mn, 0.20-0.40 wt % Si and 0.20-0.25 wt % Cr. The high carbon level of 0.80-0.84 wt % provides the pearlitic microstructure and at this carbon level the steel is at or slightly above the eutectoid point of the iron-carbon binary phase diagram. Carbon is essential because the pearlitic microstructure that develops contains about 12 wt % iron carbide (cementite) in the form of platelets imbedded alongside platelets of ferrite (forming a lamellar morphology). The cementite platelets provide hardness and wear resistance.

It has long been known that further increases in carbon can provide increased hardness of pearlite as the volume fraction of the hard cementite phase increases. When steel has a carbon level that is above the eutectoid point, however, cementite may form on the prior austenitic grain boundaries. This form of cementite is called proeutectoid cementite and the steel is referred to as hypereutectoid steel. Reduced ductility may occur in hypereutectoid steels if a continuous proeutectoid cementite network develops on the prior austenitic grain boundaries, rendering the steel brittle and unacceptable as a railroad rail.

SUMMARY OF THE INVENTION

A first aspect of the invention provides a method of making a hypereutectoid, head-hardened steel rail featuring head hardening a steel rail having a composition containing at least 0.86-1.00 wt % carbon, 0.40-0.75 wt % manganese, 0.40-1.00 wt % silicon, 0.05-0.15 wt % vanadium, 0.015-0.030 wt % titanium, and sufficient nitrogen to react with the titanium to form titanium nitrides. The head hardening is conducted at a cooling rate that, if plotted on a graph with xy-coordinates with the x-axis representing cooling time in seconds and the y-axis representing temperature in Celsius of the surface of the head of the steel rail, is maintained in a region between an upper cooling rate boundary plot defined by an upper line connecting xy-coordinates (0 s, 775° C.), (20 s, 670° C.), and (110 s, 550° C.) and a lower cooling rate boundary plot defined by a lower line connecting xy-coordinates (0 s, 750° C.), (20 s, 610° C.), and (110 s, 500° C.).

According to a second aspect of the invention, a method of making a hypereutectoid, head-hardened steel rail is provided. The method features head hardening a steel rail having a composition containing at least 0.86-1.00 wt % carbon, 0.40-0.75 wt % manganese, 0.40-1.00 wt % silicon, 0.05-0.15 wt % vanadium, 0.015-0.030 wt % titanium, and sufficient nitrogen to react with the titanium to form titanium nitride. The head hardening is conducted at a cooling rate that, if plotted on a graph with xy-coordinates with the x-axis representing cooling time in seconds and the y-axis representing temperature in Celsius of the surface of the head of the steel rail, is maintained in a region between an upper cooling rate boundary plot defined by an upper line connecting xy-coordinates (0 s, 775° C.), (20 s, 670° C.), and (110 s, 550° C.) and a lower cooling rate boundary plot defined by a lower line connecting xy-coordinates (0 s, 750° C.), (20 s, 610° C.), and (110 s, 500° C.). The cooling rate from 0 second to 20 seconds plotted on the graph has an average within a range of 5-10° C./s, and the cooling rate from 20 seconds to 110 seconds plotted on the graph is greater than a comparable air cooling rate.

A third aspect of the invention provides a method of making a hypereutectoid, head-hardened steel rail. According to this aspect, a steel rail composition is formed at a temperature of about 1600° C. to about 1650° C. by sequentially adding manganese, silicon, carbon, aluminum, followed by titanium and vanadium in any order or combination to form a steel rail composition containing at least 0.86-1.00 wt % carbon, 0.40-0.75 wt % manganese, 0.40-1.00 wt % silicon, 0.05-0.15 wt % vanadium, 0.015-0.030 wt % titanium, and sufficient nitrogen to react with the titanium to form titanium nitride. The steel rail is then head hardened at a cooling rate that, if plotted on a graph with xy-coordinates with the x-axis representing cooling time in seconds and the y-axis representing temperature in Celsius of the surface of the head of the steel rail, is maintained in a region between an upper cooling rate boundary plot defined by an upper line connecting xy-coordinates (0 s, 775° C.), (20 s, 670° C.), and (110 s, 550° C.) and a lower cooling rate boundary plot defined by a lower line connecting xy-coordinates (0 s, 750° C.), (20 s, 610° C.), and (110 s, 500° C.).

Other aspects of the invention, including apparatus, systems, articles, compositions, methods, and the like which constitute part of the invention, will become more apparent upon reading the following detailed description of the exemplary embodiments and viewing the drawings.

BRIEF DESCRIPTION OF THE DRAWING(S)

The accompanying drawings are incorporated in and constitute a part of the specification. The drawings, together with the general description given above and the detailed description of the exemplary embodiments and methods given below, serve to explain the principles of the invention. In such drawings:

FIG. 1 is an xy-coordinate graph with an x-axis representing cooling time in seconds and the y-axis representing temperature in Celsius of the surface of the steel rail, wherein an upper temperature limit is defined by the cooling from 775° C. to 670° C. over a 20-second period (at 5.3° C./s) and 670° C. to 550° C. over a subsequent 90-second period (at 1.3° C./s) and a lower temperature limit is defined by the cooling from 750° C. to 610° C. over a 20-second period (at 7.0° C./s) and 610° C. to 500° C. over a 90-second period (1.2° C./s).

FIG. 2 is a plot showing a hardness profile comparison along the vertical centerline of the rail head. Each data point represents a hardness measurement at ⅛" (inch) increments from the top surface. The horizontal dashed line represents the AREMA minimum hardness of 38.3 HRC (370 HB).

FIG. 3 is a schematic of a head-hardening machine showing the location of the independent cooling sections and the pyrometers according to an embodiment of the invention.

FIG. 4 is a plot representing the pyrometer readings of a rail passing through the head-hardening machine of FIG. 3. The four sections of the machine are shown. As can be seen, the cooling rate slows down at about 650° C. because heat is generated by the transformation of austenite to pearlite. The cooling rate going into transformation is 7.3° C./s.

FIG. 5 is a plot representing a continuous cooling transformation (CCT) or TTT diagram of eutectoid steel (0.8% C). The horizontal dotted line at 540° C. separates the pearlite transformation (P) from the bainite transformation (B). The straight solid lines represent a hypothetical cooling curve (like the one shown in FIG. 4) where the rail cools through the "nose" of the CCT diagram. Ps and Pf are the pearlite start and finish curves, respectively.

DETAILED DESCRIPTION OF EXEMPLARY EMBODIMENTS AND EXEMPLARY METHODS

Figure 1:
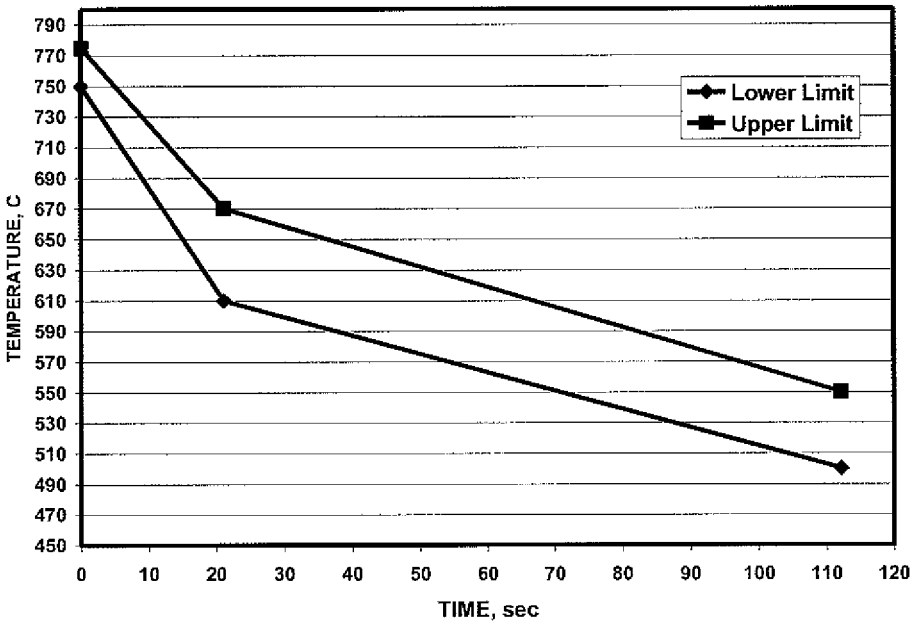

Reference will now be made in detail to exemplary embodiments and methods of the invention as illustrated in the accompanying drawings, in which like reference characters designate like or corresponding parts throughout the drawings. It should be noted, however, that the invention in its broader aspects is not limited to the specific details, representative articles and methods, and illustrative examples shown and described in connection with the exemplary embodiments and methods.

Exemplary embodiments of the invention relate to a hypereutectoid rail composition containing relatively high levels of silicon and vanadium. In production, the rail may be accelerated-cooled to achieve high hardness, yield and tensile strength significantly beyond the current AREMA specification for high strength rail. The exemplary steel compositions exhibit one or more of four different but interrelated characteristics. In particularly exemplary embodiments, the four characteristics are all concurrently possessed by the steel to yield the properties shown and explained below. These four concurrent characteristics are:

(1) Increased hardness over the conventional head-hardened C—Mn—Si rail steel through the higher carbon and silicon levels and the addition of vanadium. It is believed that the carbon increases the volume percentage of hard cementite, the silicon hardens the ferrite phase in the pearlite through solid solution strengthening, and vanadium provides precipitation hardening of the pearlitic ferrite phase through the formation of vanadium carbides.

(2) Suppression of harmful continuous proeutectoid cementite networks on the prior austenite grain boundaries. Without suppression of the proeutectoid cementite, the steel will exhibit diminished ductility and toughness. Higher levels of silicon alter the activity of carbon in austenite and thereby suppress proeutectoid cementite from forming at the boundaries. It is believed that the vanadium addition through its combination with carbon alters the morphology of proeutectoid cementite to produce discrete particles instead of continuous networks. The suppression of pro eutectoid cementite networks is also affected by a high cooling rate during transformation from austenite.

(3) Elimination of soft ferrite from forming at the rail surface during decarburization. High temperature heating practices can naturally create oxidizing conditions that cause decarburization. The higher carbon level of exemplified steel described herein is sufficient to allow decarburization to take place but insufficient to cause enough carbon loss to allow the steel to become hypoeutectoid where soft pro eutectoid ferrite forms.

(4) Prevention of heat transfer instability and lower transformation products. By shifting the pearlite transformation to shorter times, a higher cooling rate can be employed without generating undesirable heat transfer instability and bainitic/ martensitic microstructures. Lowering the manganese level to within the levels discussed herein achieves this shift.

Generally, in exemplary embodiments a new hypereutectoid rail composition is provided that comprises, consists essentially of, and/or consists of the elements and weight concentrations set forth below in Table 1:

TABLE 1

| | |
|---|---|
| carbon | 0.86-1.00 wt % |
| manganese | 0.40-0.75 wt % |
| silicon | 0.40-1.00 wt % |
| chromium | 0.20-0.30 wt % |
| vanadium | 0.05-0.15 wt % |
| titanium | 0.015-0.030 wt % |
| nitrogen | 0.0050-0.0150 wt % |

The above formulation may be modified to provide carbon in a range of 0.90-1.00 wt %.

Carbon is essential to achieve AREMA high strength rail properties. Carbon combines with iron to form iron carbide (cementite). The iron carbide contributes to high hardness and imparts high strength to rail steel. With high carbon content (above about 0.8 wt % C, optionally above 0.9 wt %) a higher volume fraction of iron carbide (cementite) continues to form above that of conventional eutectoid (pearlitic) steel. One way to utilize the higher carbon content in the new steel is by accelerated cooling (head hardening) and suppressing the formation of harmful proeutectoid cementite networks on austenite grain boundaries. As discussed below, the higher carbon level also avoids the formation of soft ferrite at the rail surface by normal decarburization. In other words, the steel has sufficient carbon to prevent the surface of the steel from becoming hypoeutectoid. Carbon levels greater than 1 wt % can create undesirable cementite networks.

Figure 5:
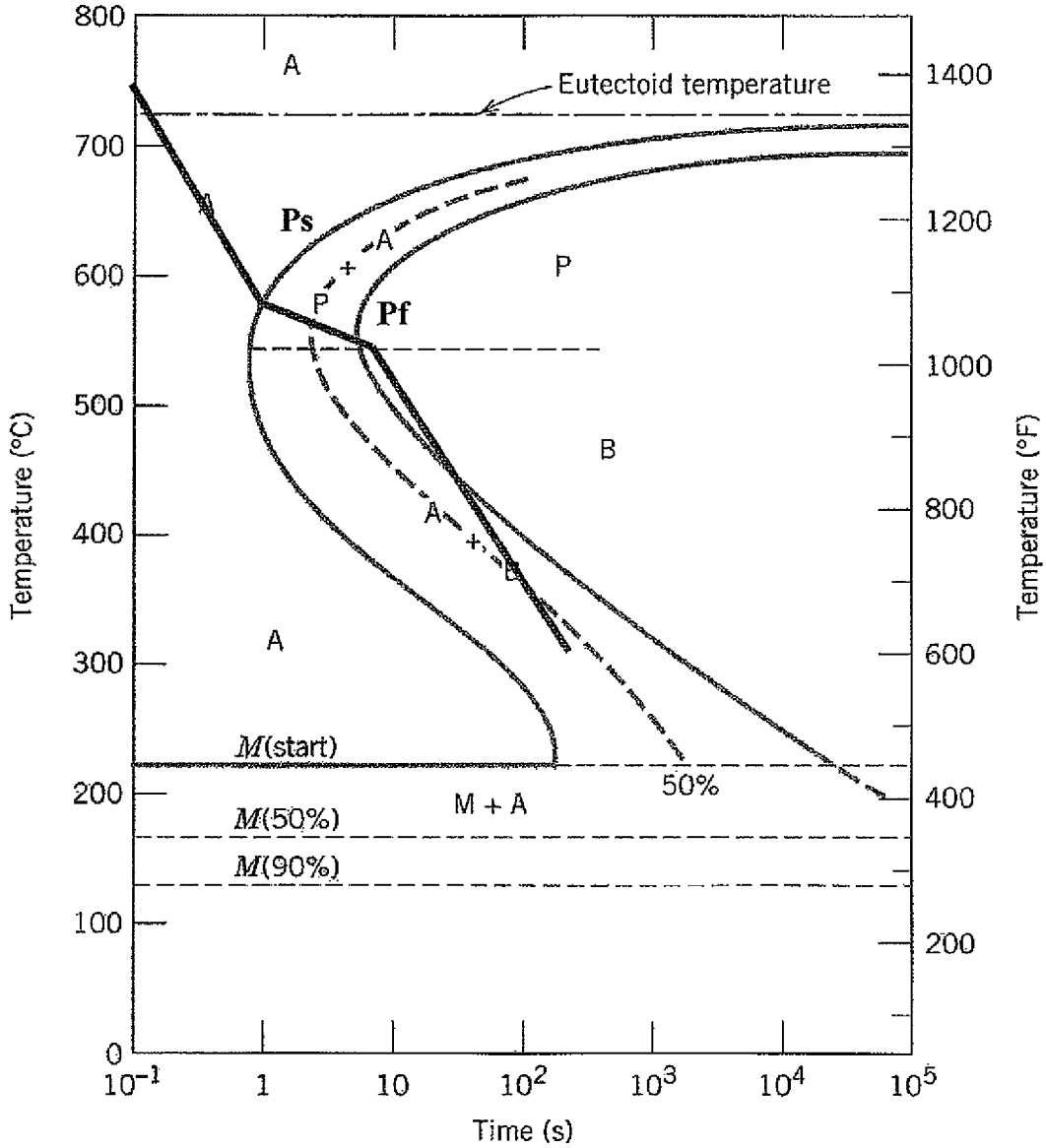

Manganese is a deoxidizer of the liquid steel and is added to tie-up sulfur in the form of manganese sulfides, thus preventing the formation of iron sulfides that are brittle and deleterious to hot ductility. Manganese also contributes to hardness and strength of the pearlite by retarding the pearlite transformation nucleation, thereby lowering the transformation temperature and deceasing interlamellar pearlite spacing. High levels of manganese (e.g., above 1%) can generate undesirable internal segregation during solidification and microstructures that degrade properties. In exemplary embodiments, manganese is lowered from a conventional head-hardened steel composition level to shift the "nose" of the continuous cooling transformation (CCT) diagram to shorter times. Referring to FIG. 5, the curve is shifted to the left. Generally, more pearlite and lower transformation products (e.g., bainite) form near the "nose." In accordance with exemplary embodiments, the initial cooling rate is accelerated to take advantage of this shift, the cooling rates are accelerated to form the pearlite near the nose. Operating the head-hardening process at higher cooling rates promotes a finer (and harder) pearlitic microstructure. However, when operating at higher cooling rates there are occasional problems with heat transfer instability where the rail overcools and is rendered unsatisfactory due to the presence of bainite or martensite. With the new composition of these exemplary embodiments, head hardening can be conducted at higher cooling rates without the occurrence of instability. Therefore, manganese is kept below 0.75% to decrease segregation and prevent undesired microstructures. The manganese level is preferably maintained above about 0.40 wt % to tie up the sulfur through the formation of manganese sulfide. High sulfur contents can create high levels of iron sulfide and lead to increased brittleness.

Silicon is another deoxidizer of the liquid steel and is a powerful solid solution strengthener of the ferrite phase in the pearlite (silicon does not combine with cementite). Silicon also suppresses the formation of continuous proeutectoid cementite networks on the prior austenite grain boundaries by altering the activity of carbon in the austenite. Silicon is preferably present at a level of at least about 0.4 wt % to prevent network formation, and at a level not greater than 1.0 wt % to avoid embrittlement during hot rolling.

Chromium provides solid solution strengthening in both the ferrite and cementite phases of pearlite.

Vanadium combines with excess carbon to form vanadium carbide (carbonitride) during transformation for improving hardness and strengthening the ferrite phase in pearlite. The vanadium effectively competes with the iron for carbon, thereby preventing the formation of continuous cementite networks. The vanadium carbide refines the austenitic grain size, and acts to break-up the formation continuous pro eutectoid cementite networks at austenite grain boundaries, particularly in the presence of the levels of silicon practiced by the exemplary embodiments of the invention. Vanadium levels below 0.05 wt % produce insufficient vanadium carbide precipitate to suppress the continuous cementite networks. Levels above 0.15 wt % can be harmful to the elongation properties of the steel.

Titanium combines with nitrogen to form titanium nitride precipitates that pin the austenite grain boundaries during heating and rolling of the steel thereby preventing excessive austenitic grain growth. This grain refinement is important to restricting austenite grain growth during heating and rolling of the rails at finishing temperatures above 900° C. Grain refinement provides a good combination of ductility and strength. Titanium levels above 0.015 wt % are favorable to tensile elongation, producing elongation values over 10%, such as 10-12%. Titanium levels below 0.015 wt % can reduce the elongation average to below 10%. Titanium levels above 0.030 wt % can produce large potentially harmful TiN particles.

Nitrogen is important to combine with the titanium to form TiN precipitates. A naturally occurring amount of nitrogen impurity is typically present in the electric furnace melting process. It may be desirable to add additional nitrogen to the composition to bring the nitrogen level to above 0.0050 wt %, which is typically a sufficient nitrogen level to allow nitrogen to combine with titanium to form titanium nitride precipitates. Generally, nitrogen levels higher than 0.0150 wt % are not necessary.

Processing and Head Hardening

Generally, steelmaking may be performed in a temperature range sufficiently high to maintain the steel in a molten stage. For example, the temperature may be in a range of about 1600° C. to about 1650° C. The alloying elements may be added to molten steel in any particular order, although it is desirable to arrange the addition sequence to protect certain elements such as titanium and vanadium from oxidation. According to one exemplary embodiment, manganese is added first as ferromanganese for deoxidizing the liquid steel. Next, silicon is added in the form of ferrosilicon for further deoxidizing the liquid steel. Carbon is then added, followed by aluminum for further deoxidation. Vanadium and titanium are added in the penultimate and final steps, respectively. After the alloying elements are added, the steel may be vacuum degassed to further remove oxygen and other potentially harmful gases, such as hydrogen.

Once degassed, the liquid steel may be cast into blooms (e.g., 370 mm×600 mm) in a three-strand continuous casting machine. The casting speed may be set at, for example, under 0.46 m/s. During casting, the liquid steel is protected from oxygen (air) by shrouding that involves ceramic tubes extending from the bottom of the ladle into the tundish (a holding vessel that distributes the molten steel into the three molds below) and the bottom of the tundish into each mold. The liquid steel may be electromagnetically stirred while in the casting mold to enhance homogenization and thus minimize alloy segregation.

After casting, the cast blooms are heated to about 1220° C. and rolled into a "rolled" bloom in a plurality (e.g., 15) of passes on a blooming mill. The rolled blooms are placed "hot" into a reheat furnace and re-heated to 1220° C. to provide a uniform rail rolling temperature. After descaling, the rolled bloom may be rolled into rail in multiple (e.g., 10) passes on a roughing mill, intermediate roughing mill and a finishing mill. The finishing temperature desirably is about 1040° C. The rolled rail may be descaled again at about 900° C. to obtain uniform secondary oxide on the rail prior to head hardening. The rail may be air cooled to about 775° C.-750° C.

Figure 3:
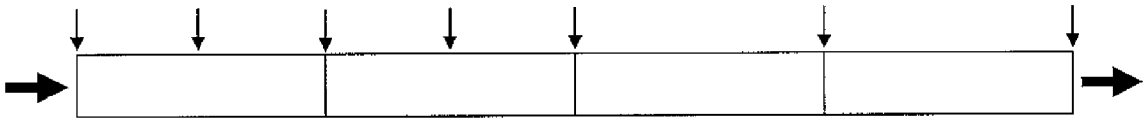
Figure 9:
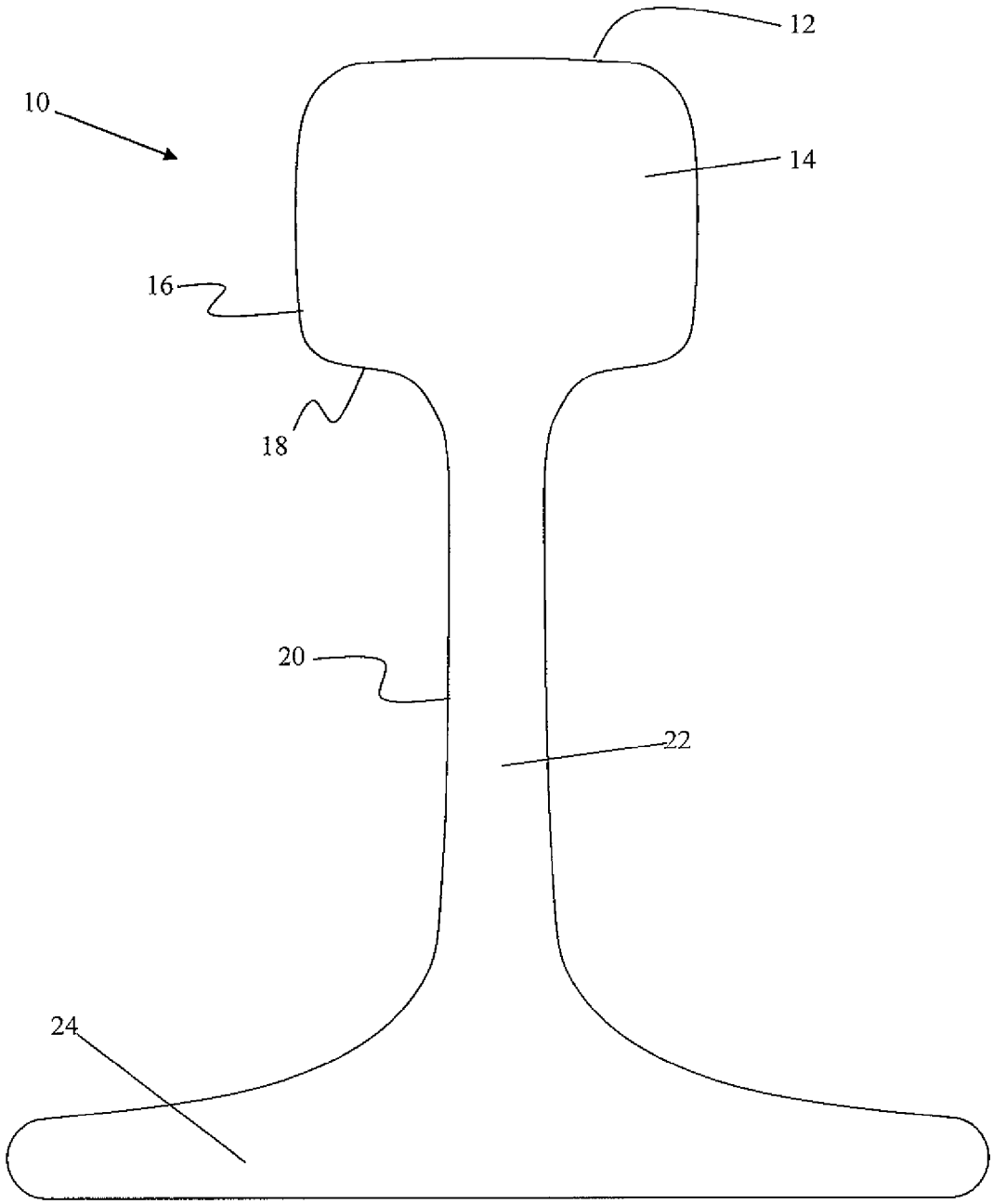
FIG. 9 is a cross section of a rail head according to an embodiment of the invention.

The rail is subjected to an in-line, head-hardening cooling process using a water-spray system. An exemplary cooling apparatus is shown in FIG. 3, in which the cooling apparatus is divided into four independent sections. For example, the cooling apparatus may be 99 or more meters in length having more than a hundred spray nozzles. The nozzles may be arranged to cool the entire surface of the rail 10, including the top 12 of the head 14, both sides 16 of the head 14, the upper and lower corners (unnumbered) of the head 14, the lower surface 18 of the head 14, both sides 20 of the web 22 of the rail 10, and the base 24 of the rail 10. (See FIG. 9). In FIG. 3, the vertical arrows designate the locations of seven pyrometers.

According to an implementation, the in-line, head-hardening cooling involves an accelerated first stage from an initial temperature in a range of about 775° C.-750° C. to an intermediate temperature in a range of about 670° C.-610° C. Depending on the line speed and size of the cooling apparatus, the spray nozzles may be positioned, for example, over the first 25 meters of the cooling apparatus. The water flow rate may be varied in the cooling apparatus to optimize heat removal and to develop the proper pearlite microstructure and hardness. Generally, the accelerated first stage is conducted to maintain the rail head surface temperature within the boundaries identified in FIG. 1. Specifically, if the cooling temperatures over the accelerated first stage were plotted on a hypothetical/imaginary graph with xy-coordinates with the x-axis representing cooling time in seconds and the y-axis temperature in Celsius of the surface of the head of the steel rail, the cooling rate would be maintained in a region between an upper cooling rate boundary plot defined by an upper line connecting xy-coordinates (0 s, 775° C.) and (20 s, 670° C.), and a lower cooling rate boundary plot defined by a lower line connecting xy-coordinates (0 s, 750° C.) and (20 s, 610° C.). By way of example, the average cooling rate during the accelerated cooling stage may fall within a range of about 5 to about 10° C./s.

Pursuant to this implementation, the in-line, head-hardening cooling then involves a gradual second stage from about the intermediate temperature in the range of 670-610° C. to a temperature in a range of about 550-500° C., as further illustrated in the graph of FIG. 1. The temperature and flow rate of water sprayed on the steel rail during this second stage produces a slower average cooling rate than that experienced in the accelerated first stage. Generally, cooling in the gradual second stage is conducted to maintain the rail head surface temperature within the boundaries identified in the graph of FIG. 1. Specifically, if the temperatures over the gradual second stage were plotted on the above-described hypothetical/imaginary graph, the cooling rate would be maintained in a region between an upper cooling rate boundary plot defined by an upper line connecting xy-coordinates (20 s, 670° C.) and (110 s, 550° C.), and a lower cooling rate boundary plot defined by a lower line connecting xy-coordinates (20 s, 610° C.) and (110 s, 500° C.). The average cooling rate during the accelerated cooling stage is preferably greater than an air cooling rate. Sufficient water flow is applied in the later sections of the cooling apparatus to allow the pearlite transformation to proceed and to remove heat evolved by the pearlite transformation.

During the first stage of cooling in accordance with an exemplary embodiment, water at a temperature of for example, about 10° C. to about 15° C. is sprayed on the top head surface 12, both side head surfaces 16 and both web surfaces 20 at a total water flow rate of about 20 to about 30 $m^3$/hr on the top head surface, about 20 to about 30 $m^3$/hr total on both on the side head surfaces and about 10 to about 20 $m^3$/hr total on both the web surfaces. In the illustrated embodiment, the first stage of cooing may take place in the first 25 meter section of the 100-meter long head-hardening device.

During the second stage of cooling in accordance with an exemplary embodiment, water at a temperature of about 10° C. to about 15° C. is sprayed on the rail in three progressively decreasing flow rates on the top surface of the rail head 12. In the second 25-meter section of the head hardening device, water flow is applied on the top head surface at a flow rate of about 25 to about 35 $m^3$/hr. In the third 25 meter-section, water flow is applied on the top head surface at a flow rate of about 12 to about 18 $m^3$/hr. In the fourth 25-meter section, water flow is applied on the top head surface at a flow rate of about 10 to about 15 $m^3$/hr. In these three sections about 20 to about 30 $m^3$/hr of water flow is applied on both the side head surfaces and about 10 to about 20 $m^3$/hr on both the web surfaces. The second stage of cooling gradually and precisely balances the extent of recalescence with the formation of a fine interlamellar spacing of the pearlite. The travel velocity of the rail in both stages may be, for example, about 0.65 to about 0.85 meter/s.

Temperature measurements are taken at the top head surface of the rail passing through the cooling apparatus. This dual stage cooling process provides a fully pearlitic microstructure without the formation of harmful continuous proeutectoid cementite networks that otherwise tend to form when rails are air-cooled or accelerated cooled at an insufficiently high rate. This dual stage cooling process provides precise control of heat extraction to prevent the heat of transformation (recalescence) from allowing the pearlite to coarsen during transformation and produce lower hardness.

EXAMPLES

Production trials: Three full-scale samples of exemplary compositions were produced into 136RE (136 pounds per yard) rail. A conventional comparative high strength rail composition (Comparative Composition A) processed the same day as the exemplary compositions (Inventive Compositions 1, 2 and 3) are compared below. The actual chemical compositions (in weight percentages) are listed in Table 2 below:

TABLE 2

| Composition | C | Mn | P | S | Si | Cr | Ni | Mo | Cu | Al | V | Ti | N |
|---|---|---|---|---|---|---|---|---|---|---|---|---|---|
| Comp 1 | 0.92 | 0.72 | 0.012 | 0.008 | 0.50 | 0.24 | 0.08 | 0.025 | 0.21 | 0.006 | 0.073 | 0.026 | 0.0084 |
| Comp 2 | 0.93 | 0.74 | 0.017 | 0.008 | 0.58 | 0.23 | 0.10 | 0.028 | 0.33 | 0.007 | 0.074 | 0.026 | 0.0075 |
| Comp 3 | 0.88 | 0.75 | 0.009 | 0.007 | 0.53 | 0.23 | 0.09 | 0.026 | 0.28 | 0.009 | 0.073 | 0.032 | 0.0085 |
| Comp. A | 0.82 | 0.99 | 0.010 | 0.010 | 0.33 | 0.23 | 0.10 | 0.037 | 0.30 | 0.008 | 0.002 | 0.020 | 0.0106 |

The compositions were produced in a 140-ton DC electric arc melting furnace with tap temperatures of 1610° C. to 1640° C. followed by treatment in an AC ladle treatment furnace (for alloy additions) and tank degassing (to remove dissolved gasses). The compositions were continuous cast into blooms of cross section 370 mm×600 mm, cut to length (−5 m) and reheated in a furnace. After heating to 1220° C., each bloom was rolled on a blooming mill to a smaller bloom cross section of 190 mm×280 mm then sheared to length to provide for a single rail. The rolled blooms were reheated to a rolling temperature (1230° C.) in a batch-type reheat furnace then rolled to a 27 meter-long rail (5 passes in a roughing mill, 3 passes in an intermediate roughing mill and 2 passes in a finishing mill). Temperature after the final rolling pass ranged from 1000-1050° C. In all trials the AREMA 136RE (136 pounds per yard) section was produced. Just after rolling, a rail end was cut with a hot saw and that cut-end of the rail entered the head-hardening machine approximately 8 minutes later at a temperature of 750-775° C. The head hardening machine was 99 meters long and consisted of 67 water spray modules with each module having 3 top head spray nozzles, 4 side head spray nozzles, and 4 web spray nozzles. There were also separate foot spray nozzles. The rail passed through these nozzle arrays in 120-150 seconds at a travel velocity of 0.65 to 0.85 m/s. The rail exited the machine with surface temperatures below 450° C. The process was thus controlled by the amount of water flow, the entry temperature and the speed of the rail as described above. Single wave length infrared pyrometers were mounted outside and inside the machine to measure rail head surface temperature at distances of approximately 0, 15, 29, 42, 56, 80 and 102 m from the machine entry pyrometer (see FIG. 3). Another pyrometer was mounted about 100 m from the exit (about 90 seconds after exit) to measure the temperature (the rebound of temperature that takes place in the rail head in air outside the head hardening machine). This temperature ranged from about 500-560° C. and is an indication of the amount of heat that was still in the head of the rail head.

Figure 2:
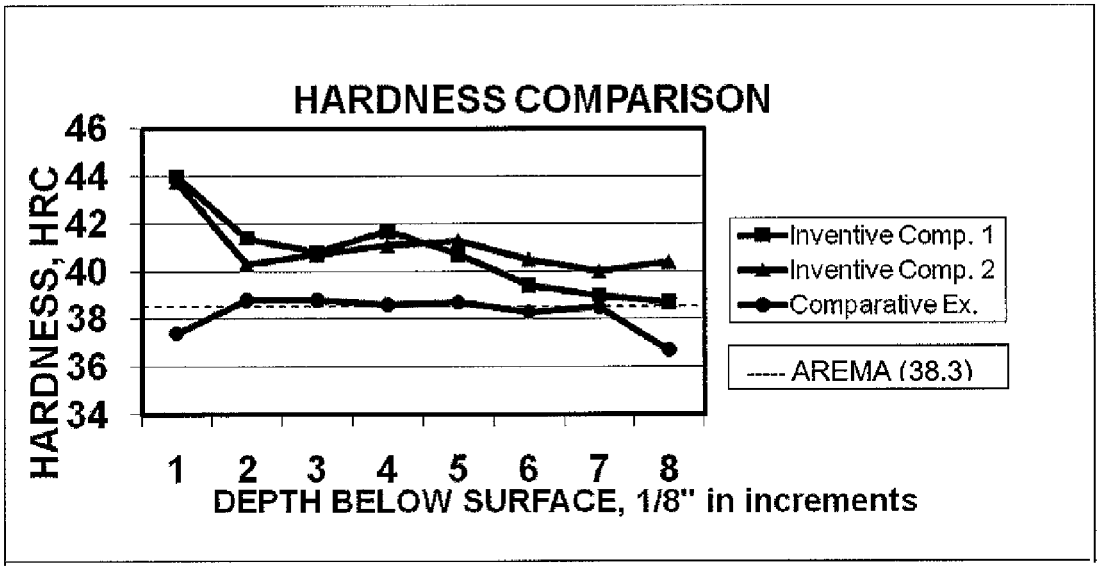

Properties. An important mechanical property of railway rail is the hardness of the head. The higher the hardness, the better the wear resistance and the longer the service life of the rail in use as track. FIG. 2 shows the hardness (Rockwell C-scale) of head-hardened rails produced from Inventive Compositions 1 and 2. Inventive Composition 3 of Table 2, not plotted, followed the same trend as Inventive Compositions 1 and 2. The hardness was measured along the centerline of the rail head starting at position 1, a depth of 3.175 mm (⅛") from the top surface, and at additional measuring points progressing in 3.175 mm (⅛") depth increments to the center at 25.4 mm (1") deep in the rail head.

The head-hardened steel rails of the exemplary compositions have higher hardness than the conventional comparative composition head-hardened steel rail. It is also seen in FIG. 2 that the hardness profiles of the exemplary Inventive Compositions 1 and 2 and the Comparative Composition A are distinctly different in that the exemplary steel compositions have high hardness at the surface that gradually decreases with depth within the rail head whereas the conventional comparative steel composition has low hardness at the surface that gradually increases with depth then decreases. It is believed that the subsurface hardness profile of the conventional steel is attributed to the loss of carbon from the surface due to the process of decarburization. This occurs in the heating practice employed to make the rail. Because the conventional steel is at or near the eutectoid carbon content, any carbon loss will shift the surface layers of the rail to a hypoeutectoid composition. In a hypoeutectoid composition, proeutectoid ferrite forms on the prior austenite grain boundaries during cooling. The microstructure thus is made up of ferrite at the surface and networks of ferrite at the austenitic grain boundaries extending inward from the surface. This is typically seen by microstructural examination of the conventional AREMA rail steels. The ferrite phase is softer than pearlite and the hardness at the surface is therefore lower than the hardness in the interior of the rail head. This explains the hardness profile of the conventional steel shown in FIG. 2.

In marked contrast, the Inventive Compositions 1 and 2 provided steel of hypereutectoid composition (specifically about 0.10% C higher than the conventional steel) and the loss of carbon at the surface from decarburization did not shift the surface layers below the eutectoid point. Thus, the surface layers of the rail head were still hypereutectoid and there was a complete absence of soft ferrite. This explains the hardness profile of the exemplary steel compositions. In order to determine the actual carbon content at the eutectoid point for the embodied steel, modeling was performed using ThermoCalc (TCW) software (www.thermocalc.com). The model shows a slice of the iron-carbon diagram as influenced by the alloying elements deliberately added to the exemplary steel samples. The result is shown for Inventive Composition 2 (Table 2) where it can be seen that the eutectoid point is at 0.679 wt % C, well below the actual carbon content of 0.94 wt % C.

Inventive Compositions 1 and 2 and the Comparative Composition A were subject to similar heating and cooling (head-hardening) processes. As shown in FIG. 2, the steel samples of Inventive Compositions 1 and 2 have higher hardness at all depths compared with the conventional steel of the Comparative Composition A. Without wishing to be bound by any theory, it is believed that the enhanced strength increment is attributable to (a) a higher volume fraction of cementite from the higher carbon level, (b) solid solution strengthening of the added silicon and (c) the precipitation strengthening of the ferrite in the lamellar pearlite by the vanadium addition.

The accelerating cooling stages for the above examples will now be described in further detail. In the case of Inventive Composition 2, a rail was cut with the hot saw to provide a control sample (Comparative Rail Example A in Table 3 below) in an air-cooled condition. The remaining rail (Inventive Rail Example 1 in Table 3 below) was head-hardened in accordance with an embodiment of the invention. Rockwell-C hardness measurements taken at 3.175 mm (⅛") depth increments along the centerline from the top surface of the rail head are compared.

TABLE 3

| Hardness, HRC | | | | | | | | |
|---|---|---|---|---|---|---|---|---|
| | Hardness Measured at Different Depths from Top Head Surface | | | | | | | |
| Rail Example | 0.125" | 0.25" | 0.375" | 0.50" | 0.625" | 0.75" | 0.875" | 1.00" |
| Comp. Rail Ex. A (Air cooled) | 34.9 | 34.1 | 33.7 | 34.6 | 34.9 | 34.6 | 35.0 | 33.4 |
| Rail Ex. 1 (Head-hardened) | 41.1 | 41.2 | 41.0 | 41.0 | 41.0 | 39.2 | 40.0 | 38.0 |

The tensile properties are compared in Table 4 below:

TABLE 4

| Rail Example | Yield Strength (ksi) | Tensile Strength (ksi) | % Total Elongation (2") |
|---|---|---|---|
| Comp. Rail Ex A: Air-cooled | 98 | 169 | 8.1 |
| Inventive Rail Ex 1: Head-hardened | 135 | 198 | 10.0 |

The above data of Table 4 demonstrates that accelerated cooling contributes to achieving improved hardness properties compared to an air-cooled comparative example.

The rail enters the head hardening machine at a specific temperature (Te=entry temperature) and passes through four independent water spray sections each 25 meters long (see FIG. 3). The spray nozzle configuration and the water flow rates are different in each section. The rail top head surface temperature was measured at entry to the machine, half way in each section and at the end of each section. (See FIG. 3). Temperature was also measured about 90 seconds (in air) after the rail exited the machine.

Figure 4:
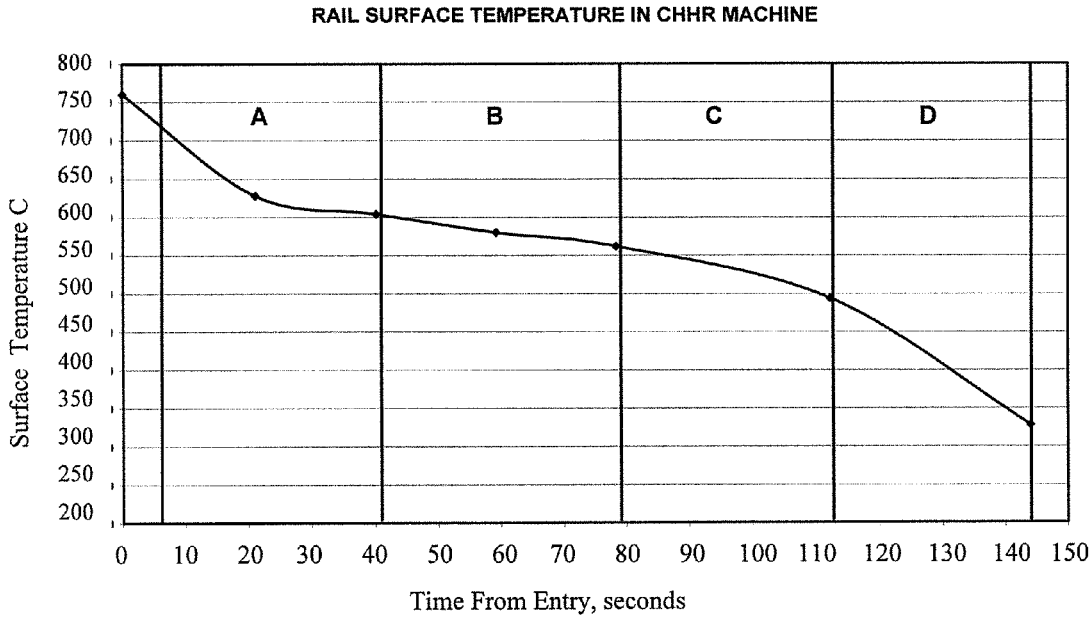

FIG. 4 shows a plot of the pyrometer measurements for the rail of Inventive Rail Example 2, which was prepared from Inventive Composition 1. The result is an actual cooling curve of the rail showing an initial cooling rate of 7.3° C./second at the beginning of head hardening followed by a slowdown in cooling caused by the heat generated by the pearlite transformation and specific control of the water cooling volumes. If the rail steel has too much alloy content or an incorrect balance of alloying elements, the pearlite reaction might not occur during the first stage of accelerated cooling, the temperature of the rail head would continue to decrease under the influence of the water sprays, and bainite would form. This is illustrated in FIG. 5 for a simple 0.80% C AISI 1080 steel. The initial accelerated cooling rate brings the rail temperature down to the area of the "nose" of the time-temperature-transformation diagram. The heat of transformation from the austenite to pearlite transformation slows the cooling and the rail transforms through the nose at the curve Ps (pearlite start temperature) and develops a fully pearlitic microstructure as it passes the curve Pf (pearlite finish temperature). Thus, a high initial cooling rate is important but it should be controlled by the proper cooling conditions in the head hardening machine and matched with the rail composition.

Figure 6A:
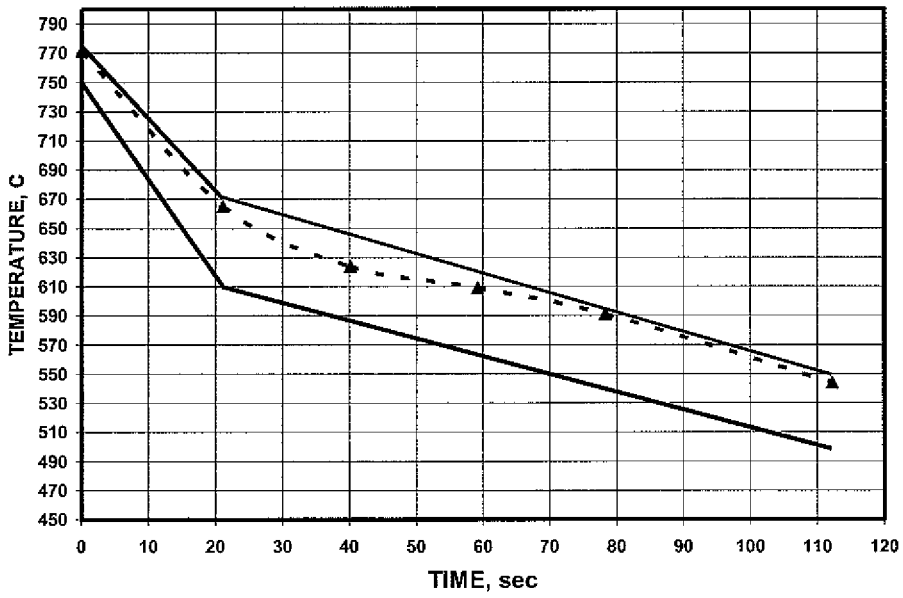
FIG. 6A is a graphical representation of a head hardening process according to an embodiment of the invention.
Figure 6B:
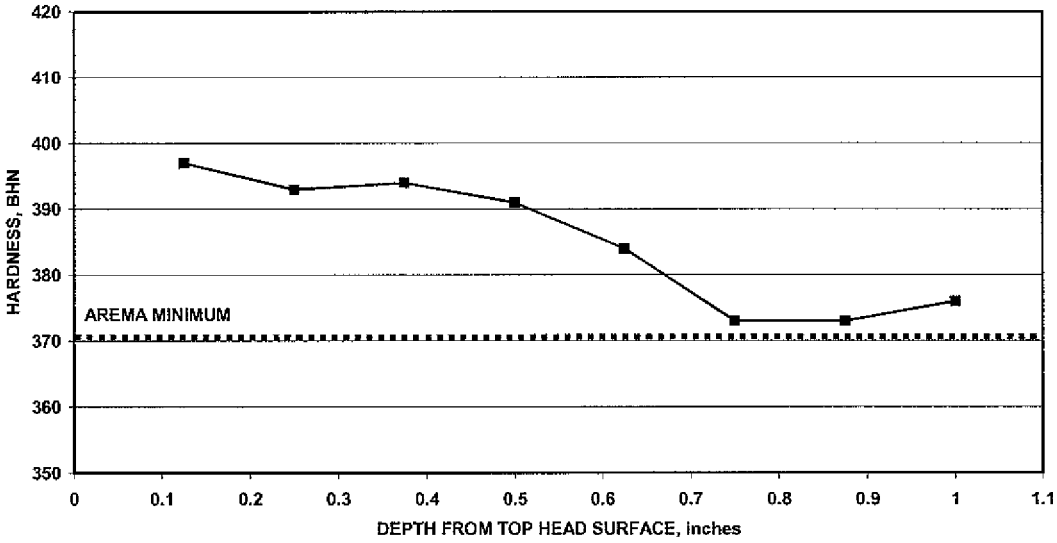
FIG. 6B represents a distribution of measured hardness properties of the embodiment.

Inventive Rail Example 3 (cooling inside the upper/lower limits). FIG. 6A is a graph of a head-hardening cooling process carried out according to the two-stage cooling process described above on Inventive Composition 1. Head hardening was conducted at a cooling rate that, if plotted on a graph with xy-coordinates with the x-axis representing cooling time in seconds and the y-axis representing temperature in Celsius of the surface of the head of the steel rail, is maintained in a region between an upper cooling rate boundary plot defined by an upper line connecting xy-coordinates (0 s, 775° C.), (20 s, 670° C.,), and (110 s, 550° C.) and a lower cooling rate boundary plot defined by a lower line connecting xy-coordinates (0 s, 750° C.), (20 s, 610° C.), and (110 s, 500° C.). FIG. 6B indicates the measured head hardness readings taken at the centerline in the resulting steel rail head. The steel rail head had Brinell hardness values in a range of 376-397 HB throughout a depth range of 3.175 mm (i.e., a surface measurement) to 25 mm (i.e., a center measurement). The steel rail head also had a Brinell hardness of at least 380 HB at a depth of ⅜" (about 9.5 mm) from every point on the surface of the head of the steel rail.

Figure 7A:
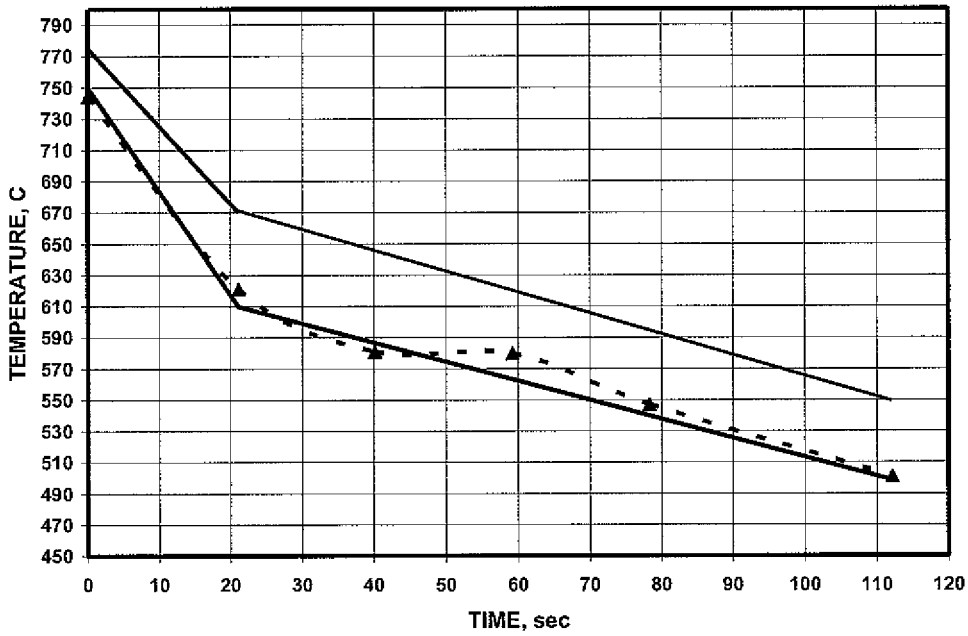
FIG. 7A is a graphical representation of a head hardening process according to a comparative example.
Figure 8A:
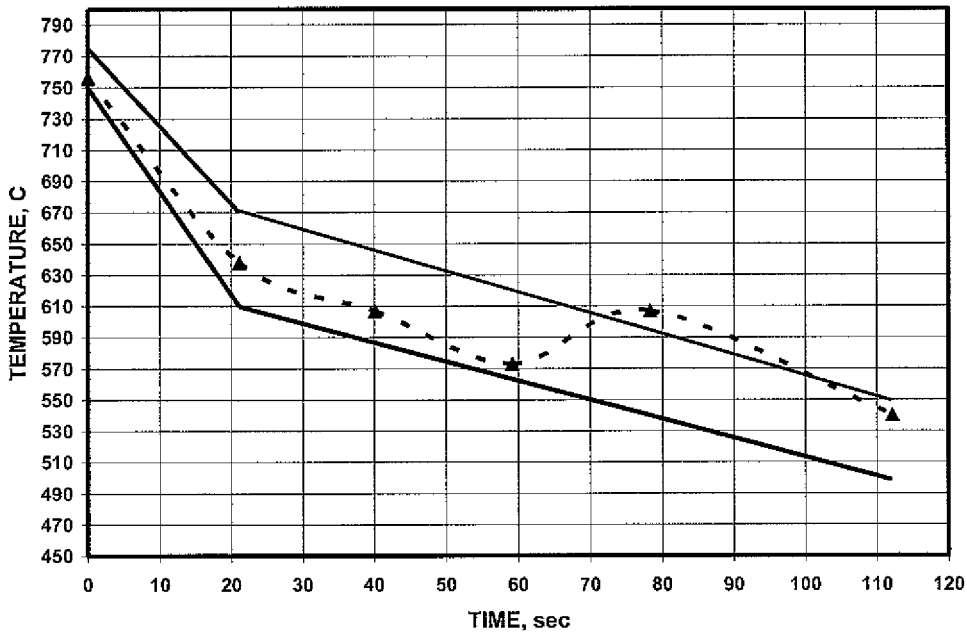
FIG. 8A is a graphical representation of a head hardening process according to a comparative example.

Comparative Rail Examples B and C (cooling outside the upper/lower limits). FIGS. 7A and 8A are graphs of a head-hardening cooling process carried out according to Comparative Rail Examples B and C. The rails of Comparative Rail Examples B and C were prepared from Inventive Compositions 2 and 3, respectively. Head hardening was conducted at a cooling rate that, if plotted on a graph with xy-coordinates with the x-axis representing cooling time in seconds and the y-axis representing temperature in Celsius of the surface of the head of the steel rail, was not maintained in a region between an upper cooling rate boundary plot defined by an upper line connecting xy-coordinates (0 s, 775° C.), (20 s, 670° C.), and (110 s, 550° C.) and a lower cooling rate boundary plot defined by a lower line connecting xy-coordinates (0 s, 750° C.), (20 s, 610° C.), and (110 s, 500° C.). In Comparative Rail Example B (FIG. 7A), the cooling rate in the second stage dropped below the lower cooling rate boundary plot around t=25-45 sec. In Comparative Rail Example C (FIG. 8A), the cooling rate in the second stage rose above the upper cooling rate boundary plot around t=72-100 sec.

Figure 7B:
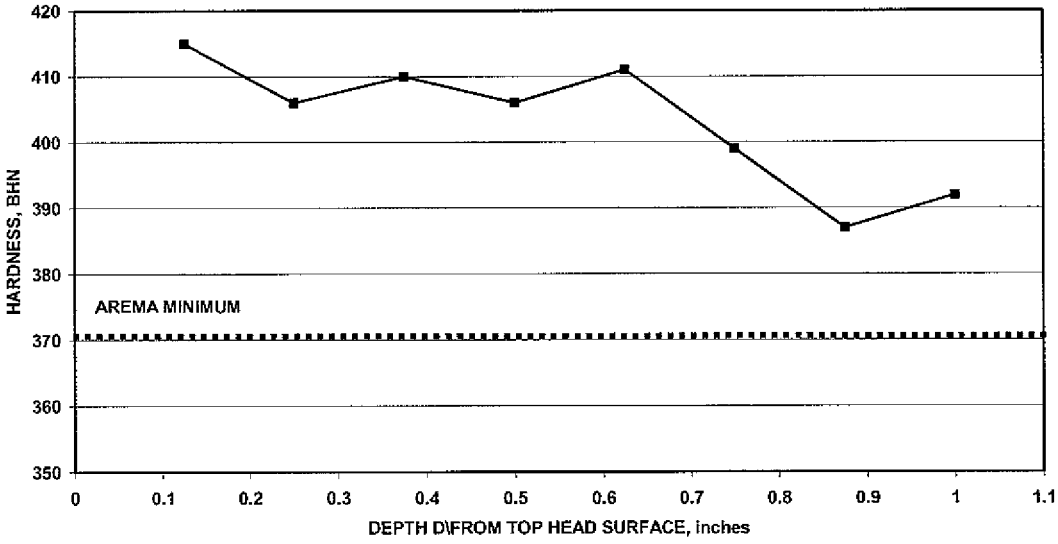
FIG. 7B represents a distribution of measured hardness properties of the comparative example.

The resulting steel rail head of Comparative Rail Example B (FIG. 7B) had a centerline distribution of hardness in the range of 392 to 415 HB. However, regions of bainite were found in the higher hardness regions of the rail head meaning that when the cooling extends below the lower limit boundary there is a danger of bainite formation in the rail head.

Figure 8B:
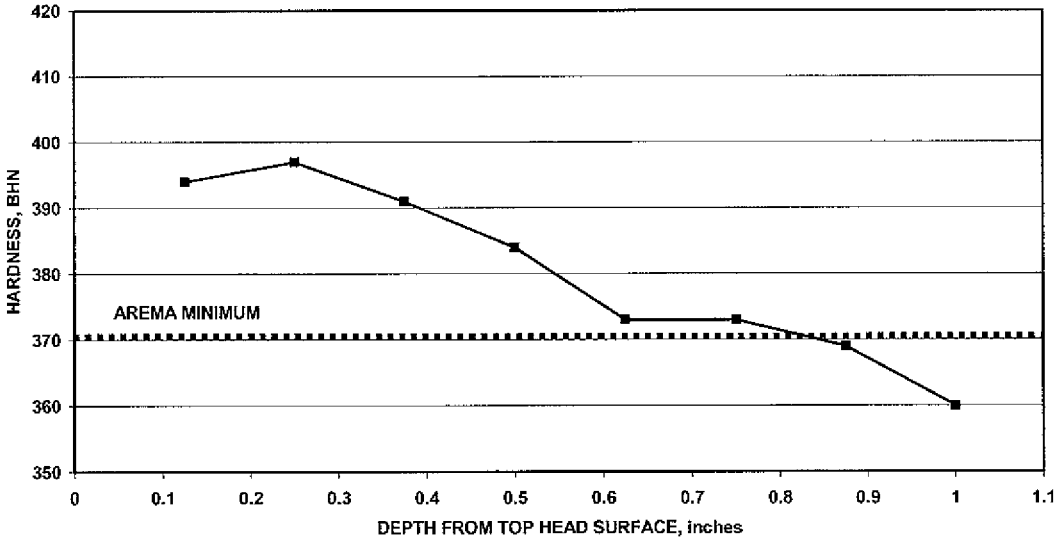
FIG. 8B represents a distribution of measured hardness properties of the comparative example.

The steel rail head of Comparative Rail Example C (FIG. 8B) also had a centerline distribution of hardness in the range of 360 to 394 HB. The hardness level near the center of the rail head was below the AREMA minimum specification of 370 HB meaning that when the cooling extends above the upper limit boundary the hardness did not meet the expected AREMA minimum hardness of 370 HB.

Unless stated otherwise, all percentages mentioned herein are by weight.

The foregoing detailed description of the certain exemplary embodiments of the invention has been provided for the purpose of explaining the principles of the invention and its practical application, thereby enabling others skilled in the art to understand the invention for various embodiments and with various modifications as are suited to the particular use contemplated. This description is not intended to be exhaustive or to limit the invention to the precise embodiments disclosed. Although only a few embodiments have been disclosed in detail above, other embodiments are possible and the inventors intend these to be encompassed within this specification and the scope of the appended claims. The specification describes specific examples to accomplish a more general goal that may be accomplished in another way. Modifications and equivalents will be apparent to practitioners skilled in this art having reference to this specification, and are encompassed within the spirit and scope of the appended claims and their appropriate equivalents. This disclosure is intended to be exemplary, and the claims are intended to cover any modification or alternative which might be predictable to a person having ordinary skill in the art.

Only those claims which use the words "means for" are to be interpreted under 35 USC 112, sixth paragraph. Moreover, no limitations from the specification are to be read into any claims, unless those limitations are expressly included in the claims.

What is claimed is:

1. A hypereutectoid, head-hardened steel rail comprising a head hardened steel rail having a composition comprising 0.86-1.00 wt % carbon, 0.40-0.75 wt % manganese, 0.40-1.00 wt % silicon, 0.05-0.15 wt % vanadium, 0.015-0.030 wt % titanium, and sufficient nitrogen to react with the titanium to form titanium nitride, wherein the head of the steel rail has a Brinell hardness of at least 370 HB at a depth of 25 mm from a center surface point of the head of the steel rail.

2. The hypereutectoid, head-hardened steel rail of claim 1, wherein the composition further comprises 0.20-0.30 wt % chromium.

3. The hypereutectoid, head-hardened steel rail of claim 2, wherein the nitrogen is present in the composition in an amount of 0.0050 to 0.0150 wt %.

4. The hypereutectoid, head-hardened steel rail of claim 1, wherein the steel rail has a head portion that has a fully pearlitic microstructure.

5. The hypereutectoid, head-hardened steel rail of claim 1, wherein the steel rail composition has 0.90-1.00 wt % carbon.

6. The hypereutectoid, head-hardened steel rail of claim 5, wherein the steel rail has a head portion that has a fully pearlitic microstructure.

7. The hypereutectoid, head-hardened steel rail of claim 1, the steel rail having been head hardened at a cooling rate that, if plotted on a graph with xy-coordinates with the x-axis representing cooling time in seconds and the y-axis representing temperature in Celsius of the surface of the head of the steel rail, is maintained in a region between an upper cooling rate boundary plot defined by an upper line connecting xy-coordinates (0 s, 775° C.), (20 s, 670° C.), and (110 s, 550° C.) and a lower cooling rate boundary plot defined by a lower line connecting xy-coordinates (0 s, 750° C.), (20 s, 610° C.), and (110 s, 500° C.).

8. The hypereutectoid, head-hardened steel rail of claim 7, wherein the cooling rate from 0 second to 20 seconds plotted on the graph has an average within a range of 5-10° C./s, and wherein the cooling rate from 20 seconds to 110 seconds plotted on the graph is greater than a comparable air cooling rate.

9. The hypereutectoid, head-hardened steel rail of claim 7, the steel rail having been formed at a temperature of about 1600° C. to about 1650° C. by sequentially adding manganese, silicon, carbon, aluminum, followed by titanium and vanadium in any order or in combination to form a steel rail composition comprising 0.86-1.00 wt % carbon, 0.40-0.75 wt % manganese, 0.40-1.00 wt % silicon, 0.05-0.15 wt % vanadium, 0.015-0.030 wt % titanium, and sufficient nitrogen to react with the titanium to form titanium nitride.

10. A hypereutectoid, head-hardened steel rail comprising a head hardened steel rail having a composition comprising 0.86-1.00 wt % carbon, 0.40-0.75 wt % manganese, 0.40-1.00 wt % silicon, 0.05-0.15 wt % vanadium, 0.015-0.030 wt % titanium, and sufficient nitrogen to react with the titanium to form titanium nitride, wherein the head of the steel rail has Brinell hardness values in a range of 370-410 HB throughout a depth range of 0-25 mm from every point on the vertical centerline of the running surface of the head of the steel rail.

11. The hypereutectoid, head-hardened steel rail of claim 10, wherein the composition further comprises 0.20-0.30 wt % chromium.

12. The hypereutectoid, head-hardened steel rail of claim 11, wherein the nitrogen is present in the composition in an amount of 0.0050 to 0.0150 wt %.

13. The hypereutectoid, head-hardened steel rail of claim 10, wherein the steel rail has a head portion that has a fully pearlitic microstructure.

14. The hypereutectoid, head-hardened steel rail of claim 10, wherein the steel rail composition has 0.90-1.00 wt % carbon.

15. The hypereutectoid, head-hardened steel rail of claim 14, wherein the steel rail has a head portion that has a fully pearlitic microstructure.

16. The hypereutectoid, head-hardened steel rail of claim 10, the steel rail having been head hardened at a cooling rate that, if plotted on a graph with xy-coordinates with the x-axis representing cooling time in seconds and the y-axis representing temperature in Celsius of the surface of the head of the steel rail, is maintained in a region between an upper cooling rate boundary plot defined by an upper line connecting xy-coordinates (0 s, 775° C.), (20 s, 670° C.), and (110 s, 550° C.) and a lower cooling rate boundary plot defined by a lower line connecting xy-coordinates (0 s, 750° C.), (20 s, 610° C.), and (110 s, 500° C.).

17. The hypereutectoid, head-hardened steel rail of claim 16, wherein the cooling rate from 0 second to 20 seconds plotted on the graph has an average within a range of 5-10° C./s, and wherein the cooling rate from 20 seconds to 110 seconds plotted on the graph is greater than a comparable air cooling rate.

18. The hypereutectoid, head-hardened steel rail of claim 16, the steel rail having been formed at a temperature of about 1600° C. to about 1650° C. by sequentially adding manganese, silicon, carbon, aluminum, followed by titanium and vanadium in any order or in combination to form a steel rail composition comprising 0.86-1.00 wt % carbon, 0.40-0.75 wt % manganese, 0.40-1.00 wt % silicon, 0.05-0.15 wt % vanadium, 0.015-0.030 wt % titanium, and sufficient nitrogen to react with the titanium to form titanium nitride.

19. A hypereutectoid, head-hardened steel rail comprising a head hardened steel rail having a composition comprising 0.86-1.00 wt % carbon, 0.40-0.75 wt % manganese, 0.40-1.00 wt % silicon, 0.05-0.15 wt % vanadium, 0.015-0.030 wt % titanium, and sufficient nitrogen to react with the titanium to form titanium nitride, wherein the head of the steel rail has a Brinell hardness of at least 370 HB at a depth of 25 mm from a center surface point of the head of the steel rail, and wherein the head of the steel rail has Brinell hardness values in a range of 370-410 HB throughout a depth range of 0-25 mm from every point on the vertical centerline of the running surface of the head of the steel rail.

20. The hypereutectoid, head-hardened steel rail of claim 19, the steel rail having been head hardened at a cooling rate that, if plotted on a graph with xy-coordinates with the x-axis representing cooling time in seconds and the y-axis representing temperature in Celsius of the surface of the head of the steel rail, is maintained in a region between an upper cooling rate boundary plot defined by an upper line connecting xy-coordinates (0 s, 775° C.), (20 s, 670° C.), and (110 s, 550° C.) and a lower cooling rate boundary plot defined by a lower line connecting xy-coordinates (0 s, 750° C.), (20 s, 610° C.), and (110 s, 500° C.).

* * * * *